US005109789A

United States Patent [19]

Berman

[11] Patent Number: 5,109,789

[45] Date of Patent: May 5, 1992

[54] PERSONAL COMPATIBILITY INDICATING DEVICE

[76] Inventor: Oded Berman, 8/28 Hashalom Street, Kfar Saba, Israel

[21] Appl. No.: 636,221

[22] Filed: Dec. 31, 1990

[51] Int. Cl.[5] ..... G08B 5/00; G09F 9/40

[52] U.S. Cl. ..... 116/325; 283/100; 283/145; 283/117

[58] Field of Search ..... 116/325, 326, 306-309, 116/311, 312, 315, 320, 222; 63/3 R, 3 K, 49 K, 31; 235/85 R, 90; 273/1 R, 459; 283/100, 105, 117; 434/430

[56] References Cited

U.S. PATENT DOCUMENTS

| | | | |
|---|---|---|---|
| 1,156,345 | 10/1915 | Burnap | 116/308 |
| 1,619,511 | 3/1927 | Hausner | 116/325 |
| 3,195,813 | 7/1965 | Hart | 235/90 |
| 3,968,661 | 7/1976 | Williams | 63/31 |
| 4,077,237 | 3/1978 | Loper | 63/31 |
| 4,594,070 | 6/1986 | Stoddard | 116/223 |

FOREIGN PATENT DOCUMENTS

| | | | |
|---|---|---|---|
| 1242237 | 8/1960 | France | 63/31 |

*Primary Examiner*—William A. Cuchlinski, Jr.
*Assistant Examiner*—W. Morris Worth
*Attorney, Agent, or Firm*—Ladas & Parry

[57] ABSTRACT

A matchmaking or personal compatibility indicating device including a base member, a plurality of visually sensible indicator locations formed on the base member for indication of characteristics by the user of the device and apparatus cooperative with the first and second plurality of visually sensible indicator locations for permitting a user to indicate his and his potential partner's desired characteristics. The base member is configured to permit base members of a user and of a potential partner to be mutually arranged in an arrangement so that the plurality of visually sensible indicator locations on one base member is positioned in registration with the plurality of visually sensible indicator locations on the other base member, such that the coincidence between the characteristics of one person and the characteristics of another person may be visually sensed.

12 Claims, 5 Drawing Sheets

PERSONAL COMPATIBILITY INDICATING DEVICE

FIELD OF THE INVENTION

The present invention relates to novelty items generally.

BACKGROUND OF THE INVENTION

Various types of novelty items are known and worn as pendants or earrings or carried by a user, for example, as a keyholder. Applicant is not aware of any novelty items which are employed as a matchmaking or personal compatibility indicating device.

SUMMARY OF THE INVENTION

The present invention seeks to provide a novelty item which provides a matchmaking or personal compatibility indicating device.

There is thus provided in accordance with a preferred embodiment of the present invention a matchmaking or personal compatibility indicating device including a base member, a plurality of visually sensible indicator locations formed on the base member for indication of personal characteristics by the user of the device and apparatus cooperative with the plurality of visually sensible indicator locations for permitting a user to indicate desired characteristics, and wherein the base member is configured to permit base members of a user and of a potential partner to be mutually arranged in an arrangement wherein the plurality of visually sensible indicator locations on one base member is positioned in registration with the plurality of visually sensible indicator locations on the other base member, such that the coincidence between the characteristics indicated by one person and the characteristics indicated by another person may be visually sensed.

There is also provided in accordance with a preferred embodiment of the present invention a matchmaking or personal compatibility indicating device including a base member, a first plurality of visually sensible indicator locations formed on the base member for indication of characteristics of the user of the device and a second plurality of visually sensible indicator locations formed on the base member for indication of characteristics desired in a potential partner by the user of the device and apparatus cooperative with the first and second pluralities of visually sensible indicator locations for permitting a user to indicate his and his potential partner's desired characteristics, and wherein the base member is configured to permit base members of a user and of a potential partner to be mutually arranged in an arrangement wherein the first plurality of visually sensible indicator locations on one base member is positioned in registration with the second plurality of visually sensible indicator locations on the other base member, such that the coincidence between the actual characteristics of one person and the characteristics desired by another person may be visually sensed.

In accordance with a preferred embodiment of the invention, the first and second pluralities of indicator locations may be defined by apertures and the apparatus for permitting a user to indicate comprise selectably positionable means which may be removably inserted in the apertures to indicate selected characteristics. The selectably positionable means may be of any suitable shape, such as cylindrical plugs, spherical members and labels. Alternatively, characteristic indications may be effected by use of a marker or other implement. For example, characteristic indications may be effected by punching out a predefined portion of the base member.

In accordance with a preferred embodiment of the present invention the base member may be formed with a protrusion and a correspondingly oriented socket so as to assist in proper mutual arrangement of two base members for registration of the locations.

The base member may be in any suitable shape and may be used also as an article of fashion, such as an earring or pendant, or as another useful article, such as a credit card, keychain or calling card.

BRIEF DESCRIPTION OF PREFERRED EMBODIMENTS

The present invention will be understood and appreciated more fully from the following detailed description, taken in conjunction with the drawings in which.

Figure 10:
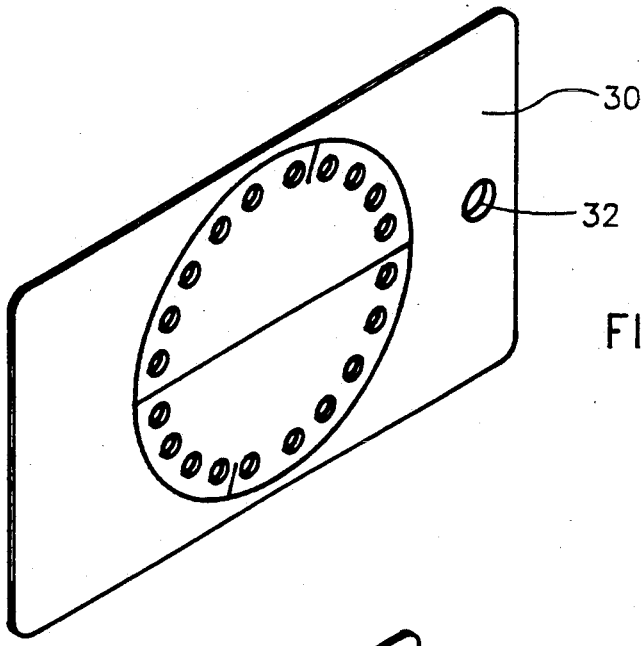
FIG. 10 illustrates an alternative embodiment of device of the type of FIGS. 1 or 6, suitable for use, for example as a credit card, calling card or luggage tag.
Figure 11:
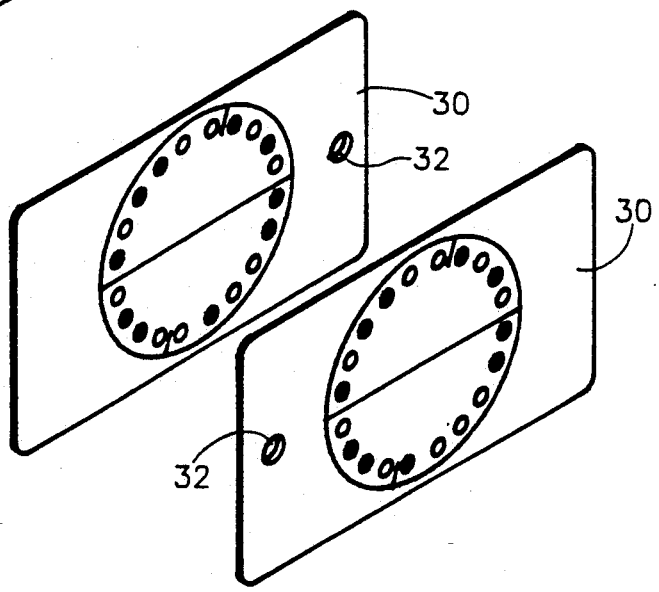
Figure 12:
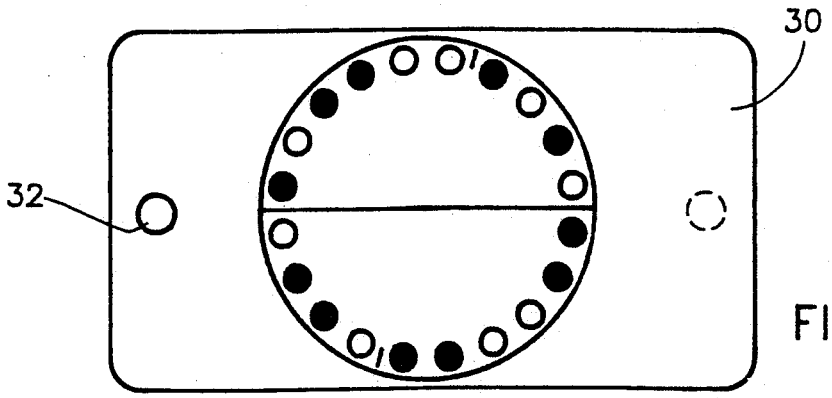

FIG. 11 illustrates the arrangement of the two devices of FIG. 10 in registration such that the first plurality of locations of one device lies in registration with the second plurality of locations of the other device; and FIG. 12 illustrates the mutual engagement of the two devices of FIG. 10 such that the first plurality of locations of one device lies in registration with the second plurality of locations of the other device as shown in FIG. 11.

DETAILED DESCRIPTION OF PREFERRED EMBODIMENTS

Figure 1:
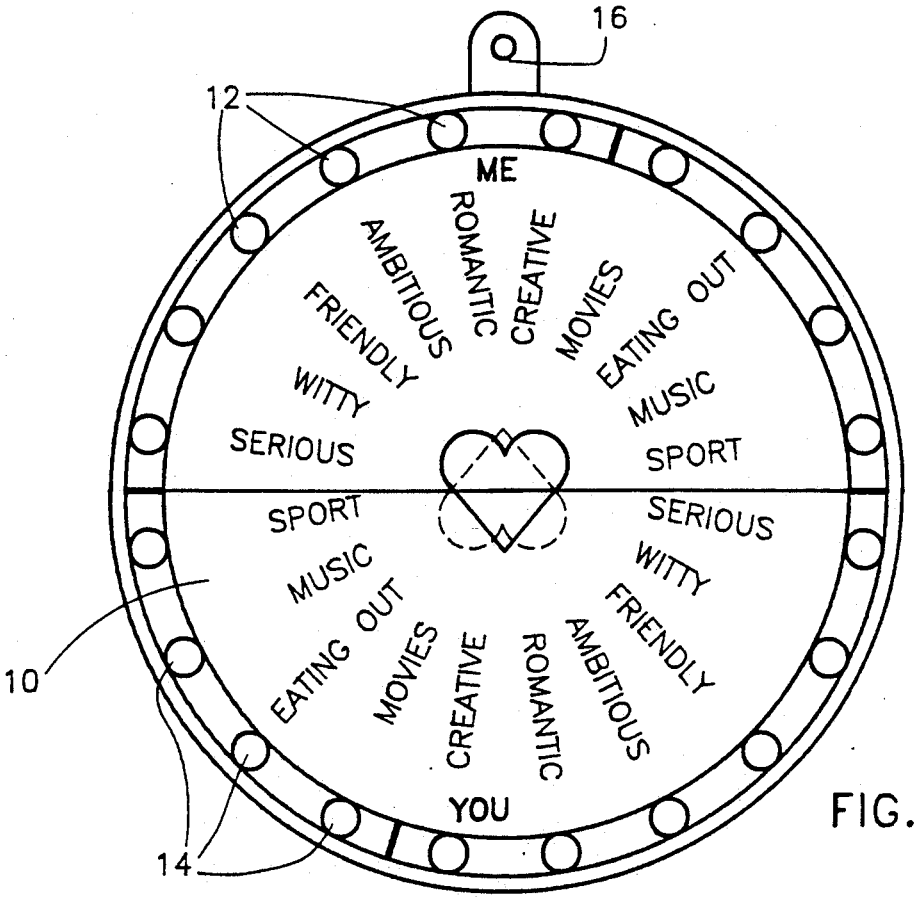
FIG. 1 is a plan view illustration of a matchmaking or personal compatibility indicating device constructed and operative in accordance with a preferred embodiment of the present invention.

Reference is now made to FIG. 1, which illustrates a matchmaking or personal compatibility indicating device constructed and operative in accordance with a preferred embodiment of the present invention. The device preferably includes a base member 10, which is typically formed of plastic, and is formed to define first and second pluralities 12 and 14 of visually sensible indicator locations. The visually sensible indicator locations are preferably configured as throughgoing apertures but may alternatively be configured in any other suitable manner.

Preferably each individual one of the first and second pluralities 12 and 14 of visually sensible indicator locations is labeled with a particular characteristic of a person. The characteristics may be behavioral characteristics, for example, such as serious, witty, friendly, romantic, etc. or alternatively or additionally interests, such as movies, sport, music etc. Alternatively or additionally any other suitable characteristics may be indicated.

According to a preferred embodiment of the present invention, an identical set of characteristics is identified with each of the first and second pluralities 12 and 14 of visually sensible indicator locations. Normally one of the first and second pluralities 12 and 14, of locations and corresponding characteristic sets is identified with the user of the device and the other is identified as the desired set of characteristics of a potential partner. Thus in the illustrated example of FIG. 1, plurality 12 is identified by the legend "ME", while plurality 14 is identified by the legend "YOU".

Figure 7:
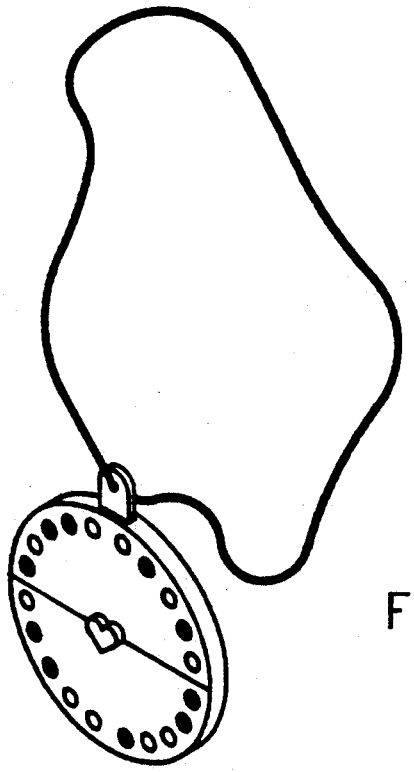
FIG. 7 illustrates a device of the type shown in FIGS. 1–6 used as a pendant.
Figure 8:
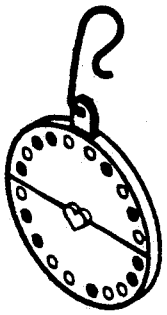
FIG. 8 illustrates a device of the type shown in FIGS. 1–6 used as an earring.
Figure 9:
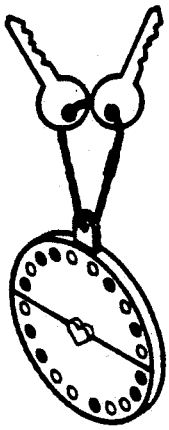
FIG. 9 illustrates a device of the type shown in FIGS. 1–6 used as a keyholder.

In accordance with one embodiment of the present invention, the base member 10 is formed with an attachment member 16, which may be apertured, enabling the base member to be worn as an earring or pendant, as illustrated generally in FIGS. 7 and 8 or used as a keychain as illustrated generally in FIG. 9.

In the illustrated embodiment of FIG. 1, characteristic selections are made, by placement of a suitable insert in selected ones of the apertures which define locations 12 and 14. The stopper may be a sphere or alternatively any other suitable member, such as a generally cylindrical plug or any other suitable filler. Placement may be permanent or changeable. For example, characteristics selections may be made using an implement such as a marker, or by employing a sticker, or as a further alternative, by removing a predetermined portion of the base member.

In accordance with a preferred embodiment of the invention, a protrusion and socket arrangement is provided on opposite flat surfaces of the base member 10. In the illustrated embodiment of FIG. 1, the protrusion and socket, indicated respectively by reference numerals 18 and 20 are in the form of corresponding heart shapes and are arranged to permit mutual engagement of two base members in an arrangement wherein the plurality 12 of locations of one device lies in registration with the plurality 14 of locations of another device.

Figure 2A:
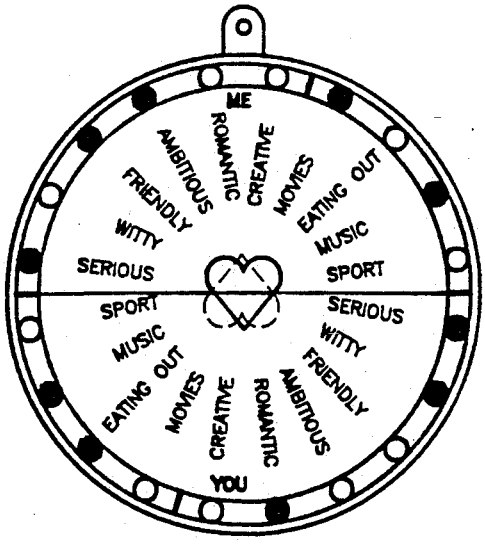
FIGS. 2A and 2B are illustrations of two devices of the type illustrated in FIG. 1 arranged side-by-side in opposite orientations, such that if placed one upon the other, corresponding actual and desired characteristic indication locations will overlap.
Figure 2B:
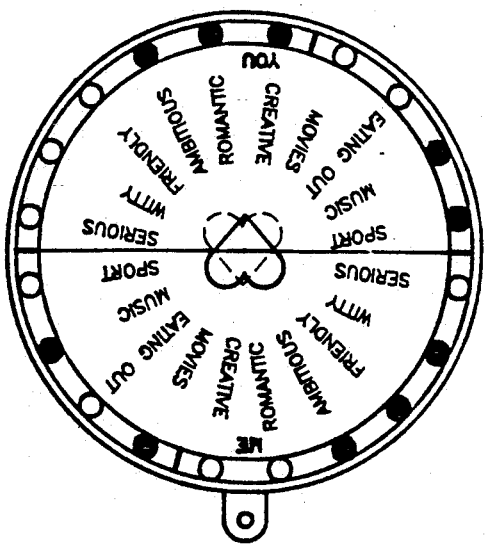
Figure 3:
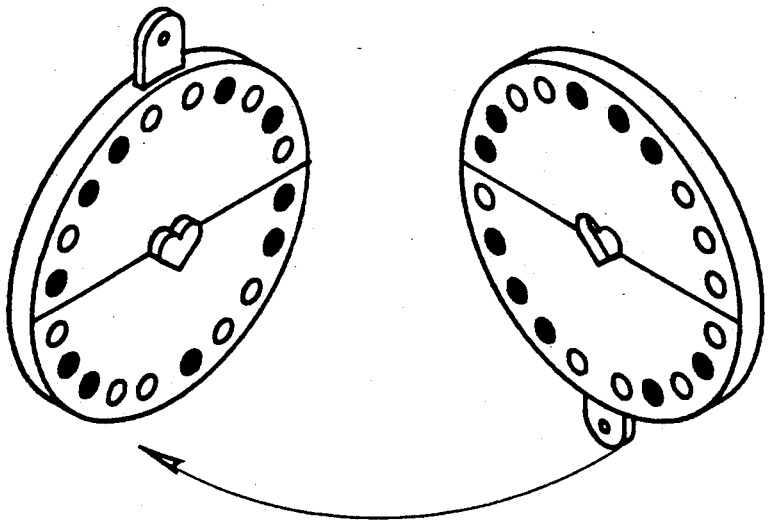
FIG. 3 illustrates two devices of the type illustrated in FIG. 1 and oriented as illustrated in FIGS. 2A and 2B, being brought into mutual engagement.
Figure 4:
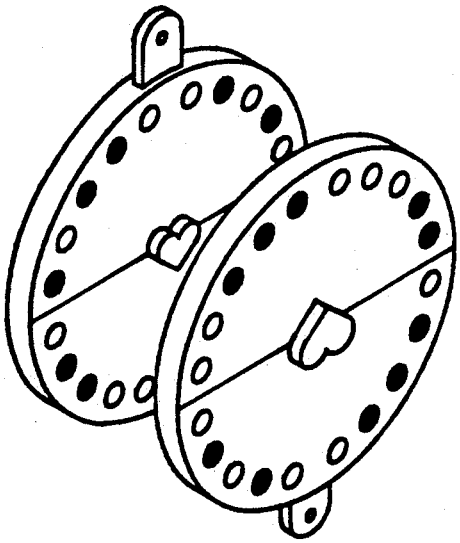
FIG. 4 illustrates the arrangement of the two devices in registration such that the first plurality of locations of one device lies in registration with the second plurality of locations of the other device.
Figure 5:
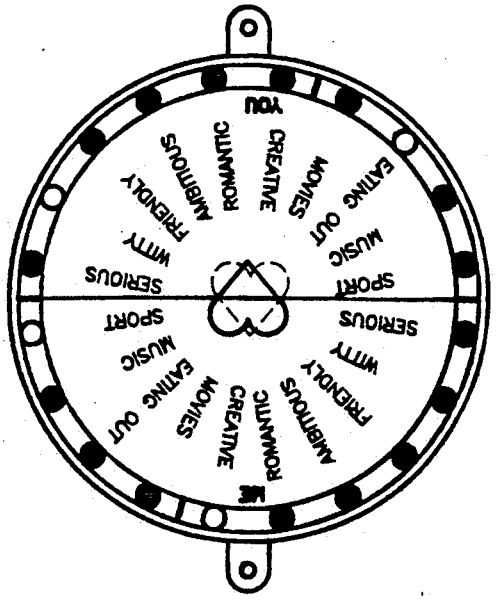
FIG. 5 illustrates the mutual engagement of the two devices such that the first plurality of locations of one device lies in registration with the second plurality of locations of the other device as shown in FIG. 4.

In this way, it will be appreciated, the ME characteristic selections of one device are aligned in registration with the YOU characteristic selections of a second device. This arrangement may be seen in FIGS. 2A and 2B. FIG. 3 illustrates how the devices of FIG. 3 are brought into registration, while FIG. 4 illustrates generally the registration between two devices and FIG. 5 illustrates the two devices in engagement with the respective YOU and ME pluralities of locations in desired registration.

Compatibility between the actual characteristics of the two persons represented by the two devices and the desired characteristics indicated by each user can readily be identified in a case when an identical number of characteristics is identified by each user, simply by counting the number of locations which are not indicated. This indicates the congruence of the matching between the desired characteristics indicated by one party with the actual characteristics indicated by the other.

Figure 6:
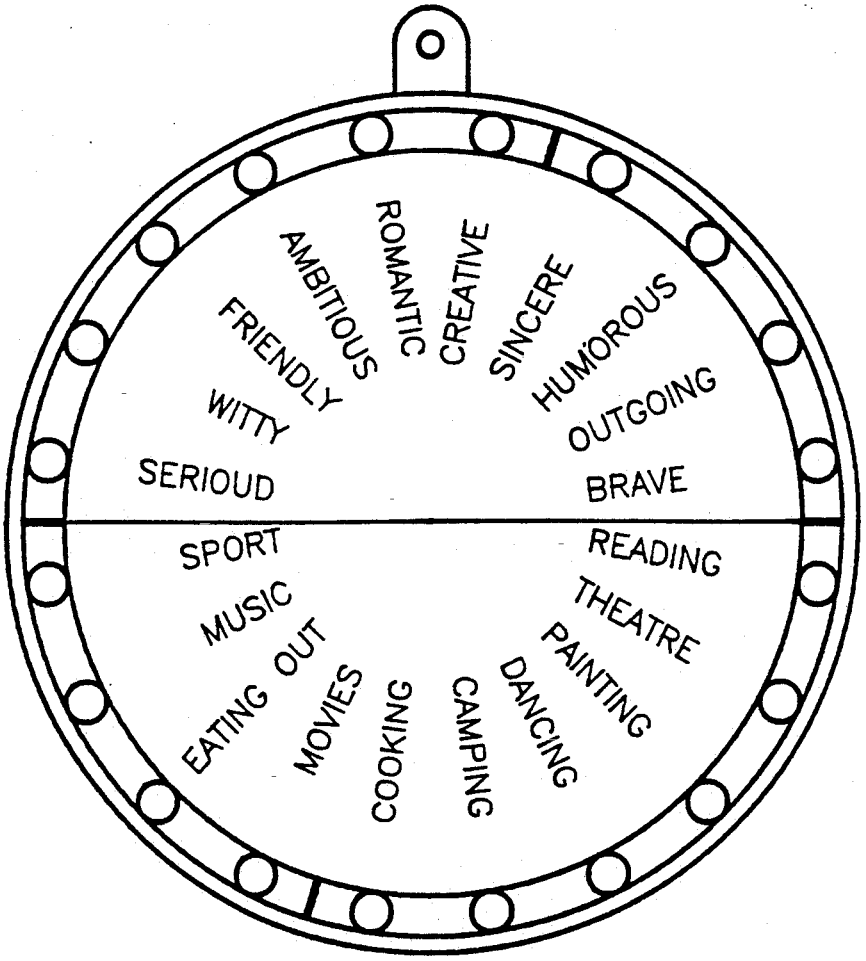
FIG. 6 is a plan view illustration of a matchmaking or personal compatibility indicating device constructed and operative in accordance with an alternative embodiment of the present invention.

Reference is now made to FIG. 6, which illustrates an alternative embodiment of the invention, wherein the two pluralities of characteristics, corresponding to "ME" and "YOU" are replaced by a single collection of characteristics. These may include activities, opinions, character traits, hobbies and the like and normally will reflect characteristics which are both present in the user and desired in a potential partner.

Matching of two base members is achieved by merely bringing them into matched engagement without mutual rotation therebetween.

Reference is now made to FIGS. 10–12 which illustrate a device, which may operate essentially similarly or identically to that described in FIGS. 8–10, in the form of a credit card, calling card, luggage tag or the like. Here the base member 30 is generally rectangular and may have an integrated aperture 32. Normally the protrusion/socket arrangement described above in connection with FIGS. 1–7 will not be provided.

It will be appreciated by persons skilled in the art that the present invention is not limited by what has been particularly shown and described herein. Rather the scope of the present invention is defined only by the claims which follow:

I claim:

1. A matchmaking or personal compatibility indicating device comprising:

a base member;

means for indication of personal characteristics including a plurality of visually sensible indicators on the base member for indication of characteristics by a user; and engagement means associated with the base member to permit the base member of the user and a similar base member of a potential partner to be mutually joined in an overlying arrangement wherein the plurality of visually sensible indicators on the user's base member is positioned in registration with a plurality of visually sensible indicators on the potential partner's base member such that a coincidence between characteristics indicated thereby may be visually sensed.

2. A matchmaking or person compatibility indicating device comprising:

a base member;

a first plurality of visually sensible indicator means on the base member for indication of characteristics of a user; and a second plurality of visually sensible indicator means formed on the base member for indication of characteristics desired in a potential partner by the user; and engagement means associated with the base member for selectively joining the base member of the user and a similar base member of a potential partner in a mutually overlapping arrangement wherein the first plurality of visually sensible indicator means on the user's base member is positioned in registration with a second plurality of visually sensible indicator means on the potential partner's base member such that a coincidence between characteristics indicated thereby may be visually sensed.

3. Apparatus according to claim 1 wherein said engagement means comprises a protrusion formed on one side of said base member and a correspondingly oriented socket formed on an opposite side thereof for the mutual joining of the base members for the registration of the pluralities of indicators respectively thereon.

4. Apparatus according to claim 1 and wherein said user's base member defines part of an earring.

5. Apparatus according to claim 1 and wherein said user's base member defines part of a pendant.

6. Apparatus according to claim 1 and wherein said user's base member defines a credit card.

7. Apparatus according to claim 1 and wherein said base member defines a tag.

8. Apparatus according to claim 2 wherein said engagement means comprises a protrusion formed on one side of said base member and a correspondingly oriented socket formed on an opposite side thereof for the selective joining of the base members for the registration of the pluralities of indicator means respectively thereon.

9. Apparatus according to claim 2 and wherein said user's base member defines part of an earring.

10. Apparatus according to claim 2 and wherein said user's base member defines part of a pendant.

11. Apparatus according to claim 2 and wherein said user's base member defines a credit card.

12. Apparatus according to claim 2 and wherein said user's base member defines a tag.

* * * * *